US010718291B2

(12) United States Patent
Burns et al.

(10) Patent No.: US 10,718,291 B2
(45) Date of Patent: Jul. 21, 2020

(54) CYLINDER LINER FOR AN INTERNAL COMBUSTION ENGINE AND METHOD OF FORMING

(71) Applicant: Ford Global Technologies, LLC, Dearborn, MI (US)

(72) Inventors: Jonathan Burns, Windsor (CA); Robert Rentschler, Dearborn, MI (US); Brian Nellenbach, Grosse Ille, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 64 days.

(21) Appl. No.: 15/841,595

(22) Filed: Dec. 14, 2017

(65) Prior Publication Data

US 2019/0186407 A1 Jun. 20, 2019

(51) Int. Cl.

| | |
|---|---|
| ***F02F 1/00*** | (2006.01) |
| ***F02F 1/10*** | (2006.01) |
| ***B22D 19/00*** | (2006.01) |

(52) U.S. Cl.

CPC ..... *F02F 1/004* (2013.01); *F02F 1/10* (2013.01); *B22D 19/009* (2013.01); *F02F 2001/008* (2013.01); *F02F 2200/00* (2013.01)

(58) Field of Classification Search

CPC combination set(s) only.
See application file for complete search history.

(56) References Cited

U.S. PATENT DOCUMENTS

| | | | |
|---|---|---|---|
| 5,363,821 | A | 11/1994 | Rao et al. |
| 5,365,997 | A | 11/1994 | Helgesen et al. |
| 5,582,144 | A | 12/1996 | Mizutani |
| 5,771,955 | A | 6/1998 | Helgesen et al. |
| 6,354,259 | B2 | 3/2002 | Fischer et al. |
| 7,000,584 | B1 | 2/2006 | Wynveen et al. |
| 7,191,770 | B1 | 3/2007 | Anderson et al. |
| 7,533,647 | B2 | 5/2009 | Miyamoto et al. |
| 8,037,860 | B2 | 10/2011 | Takami et al. |

(Continued)

FOREIGN PATENT DOCUMENTS

EP 2175116 A1 4/2010

OTHER PUBLICATIONS

Suzuki et al., "Development of New V6 3.5L Gasoline Engine for Acura RLX", SAE International, vol. 6, Issue 1, May 2013, 8 pages.

(Continued)

*Primary Examiner* — Lindsay M Low
*Assistant Examiner* — Ruben Picon-Feliciano
(74) *Attorney, Agent, or Firm* — Brooks Kushman P.C.; Geoffrey Brumbaugh

(57) ABSTRACT

A method of forming an engine is provided. A liner is cast with an outer surface with a first texture extending circumferentially from a first end to a second end of the liner. A circumferential section of the outer surface of the liner is coated with an insulative, thermoset material with a lower thermal conductivity than the texture. An engine and a cylinder liner for the engine are provided. The liner has first and second ends with an outer surface extending therebetween. An outer surface of the liner has axial sections defining a texture and an insulative thermoset coating to form material interfaces with the block with different thermal conductivities thereacross.

14 Claims, 4 Drawing Sheets

(56) References Cited

U.S. PATENT DOCUMENTS

| | | | | |
|---|---|---|---|---|
| 8,402,881 | B2 | 3/2013 | Sato et al. | |
| 9,089,893 | B2 | 7/2015 | Horigome et al. | |
| 2006/0249105 | A1 | 11/2006 | Azevedo | |
| 2007/0012179 | A1* | 1/2007 | Takami ..... | B22D 19/0009 92/171.1 |
| 2010/0206261 | A1 | 8/2010 | Berghian et al. | |
| 2013/0055993 | A1 | 3/2013 | Kantola et al. | |
| 2016/0040620 | A1 | 2/2016 | Highum | |
| 2016/0177863 | A1 | 6/2016 | Hamada et al. | |
| 2016/0326979 | A1 | 11/2016 | Baek et al. | |

OTHER PUBLICATIONS

U.S. Appl. No. 15/472,903, entitled "Cylinder Liner For An Internal Combustion Engine and Method of Forming", filed Mar. 29, 2017, 29 pages.

* cited by examiner

CYLINDER LINER FOR AN INTERNAL COMBUSTION ENGINE AND METHOD OF FORMING

TECHNICAL FIELD

Various embodiments relate to a cylinder liner for an internal combustion engine and a method of making the cylinder liner and engine.

BACKGROUND

Internal combustion engines require thermal management to control the temperature of the components of the engine. For example, a cylinder block commonly has a cooling jacket with a circulating fluid flowing therethrough to cool the block and the cylinder liners in the block. During engine operation, the bore wall of a cylinder liner may have a non-uniform temperature axially or along the length of the liner, for example, due to higher temperature gases in the upper region of the liner. The variation in bore wall temperature may lead to distortion of the cylinder liner such that the bore wall becomes non-cylindrical and/or changes shape along a length of the liner. Cylinder bore distortion may result in the piston rings having difficulty conforming to the cylinder wall during engine operation as the bore shape changes, and this in turn may lead to higher blow-by of combustion gases, increased engine oil or lubricant consumption, additional engine noise, wear of the piston rings, and reduced engine efficiency and fuel economy.

SUMMARY

According to an embodiment, an engine is provided with a cylinder liner having an outer surface and an inner surface extending from a first end to a second end of the liner, and a cylinder block formed about the cylinder liner with a first end of the liner adjacent to a deck face of the block. The defines a cooling jacket extending circumferentially about at least a portion of the outer surface of the liner and spaced apart therefrom. A first circumferential section of the outer surface of the liner has a texture forming a first material interface with the block, with the first material interface having a first thermal conductivity thereacross. A second circumferential section of the outer surface of the liner has the texture with a coating provided thereon and forming a second material interface with the block. The coating comprises a thermoset resin. The second material interface has a second thermal conductivity thereacross, with the second thermal conductivity being less than the first thermal conductivity. The first circumferential section is positioned between the first end and the second circumferential section.

According to another embodiment, a method of forming an engine is provided. A liner is formed with an outer surface defining a texture extending circumferentially about the liner. A coating is provided on a portion of the texture spaced apart from an end of the liner and extending circumferentially about the liner, the coating having a lower thermal conductivity than the liner.

According to yet another embodiment, an engine cylinder liner is provided with a tubular member having first and second ends with an outer surface extending therebetween and defining an axial section with a texture. The texture and the liner have a first thermal conductivity. A coating is provided circumferentially about only a portion of the axial section, and the coating has a second thermal conductivity that is less than the first thermal conductivity.

DETAILED DESCRIPTION

As required, detailed embodiments of the present disclosure are provided herein; however, it is to be understood that the disclosed embodiments are merely exemplary and may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present disclosure.

Figure 1:
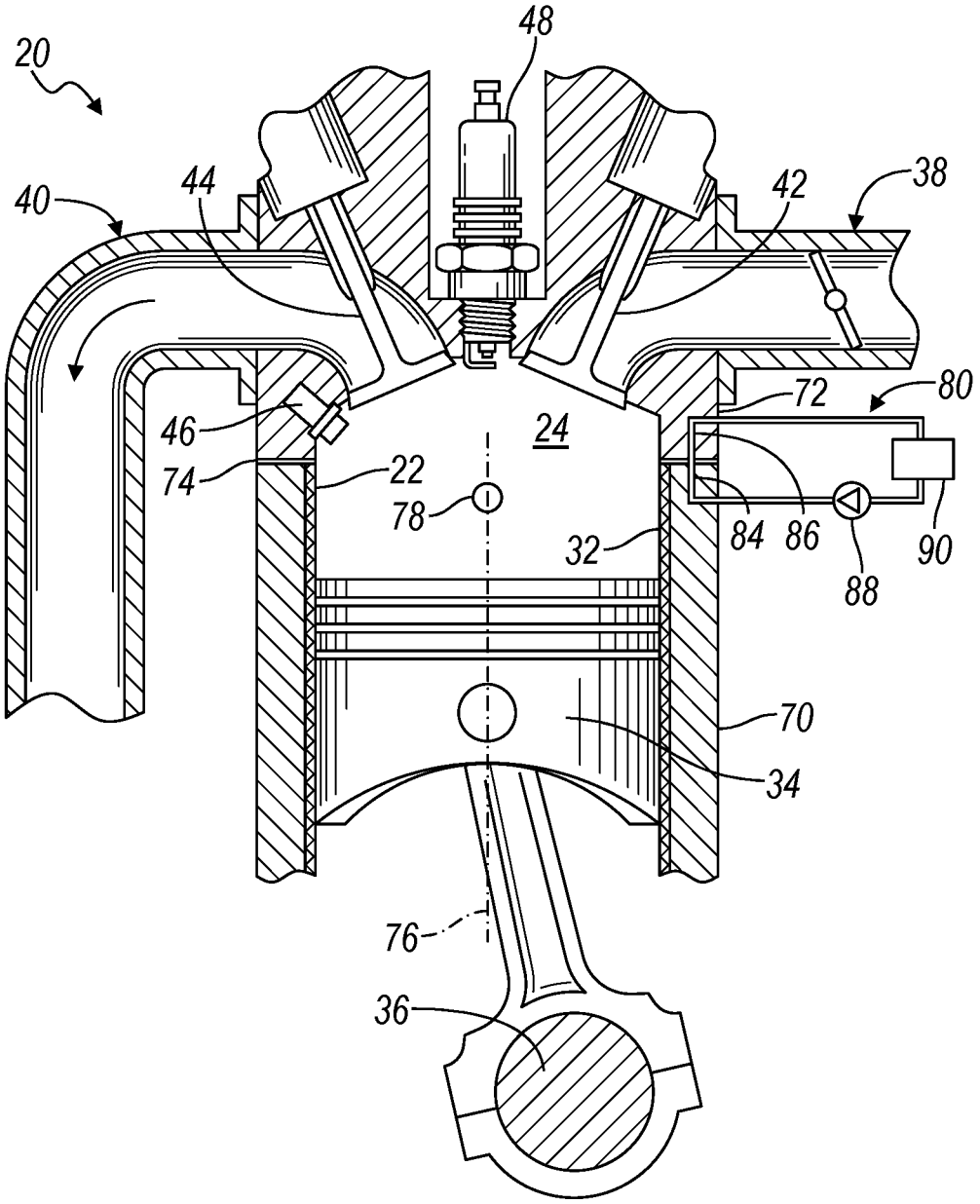
FIG. 1 illustrates a schematic of an internal combustion engine according to an embodiment.

FIG. 1 illustrates a schematic of an internal combustion engine 20. The engine 20 has a plurality of cylinders 22, and one cylinder is illustrated. In one example, the engine 20 is an in-line, four cylinder engine, and, in other examples, has other arrangements and numbers of cylinders. In one example, the cylinders may be arranged using separate liners. In various examples, the cylinder block may have a closed deck configuration, a semi-open deck configuration, or an open deck configuration.

The engine 20 has a cylinder liner 32 that defines a cylinder, cylinder wall or bore wall 22; and the engine has a combustion chamber 24 associated with each cylinder 22. The liner 32 and piston 34 cooperate to define the combustion chamber 24. The piston 34 is connected to a crankshaft 36 to convert linear movement of the piston 34 to rotary motion of the crankshaft 36.

The combustion chamber 24 is in fluid communication with the intake manifold 38 and the exhaust manifold 40. An intake valve 42 controls flow from the intake manifold 38 into the combustion chamber 24. An exhaust valve 44 controls flow from the combustion chamber 24 to the exhaust manifold 40. The intake and exhaust valves 42, 44 may be operated in various ways as is known in the art to control the engine operation.

A fuel injector 46 delivers fuel from a fuel system directly into the combustion chamber 30 such that the engine is a direct injection engine. A low pressure or high pressure fuel injection system may be used with the engine 20, or a port injection system may be used in other examples. An ignition system includes a spark plug 48 that is controlled to provide energy in the form of a spark to ignite a fuel air mixture in the combustion chamber 30. In other embodiments, other fuel delivery systems and ignition systems or techniques may be used, including compression ignition.

The engine 20 includes a controller and various sensors configured to provide signals to the controller for use in controlling the air and fuel delivery to the engine, the ignition timing, the power and torque output from the engine, and the like. Engine sensors may include, but are not limited to, an oxygen sensor in the exhaust manifold 40, an engine coolant temperature, an accelerator pedal position sensor, an engine manifold pressure (MAP sensor), an engine position sensor for crankshaft position, an air mass sensor in the intake manifold 38, a throttle position sensor, and the like.

In some embodiments, the engine 20 is used as the sole prime mover in a vehicle, such as a conventional vehicle, or a stop-start vehicle. In other embodiments, the engine may be used in a hybrid vehicle where an additional prime mover, such as an electric machine, is available to provide additional power to propel the vehicle.

Each cylinder 22 may operate under a four-stroke cycle including an intake stroke, a compression stroke, an ignition stroke, and an exhaust stroke. In other examples, the engine 20 may operate as a two-stroke cycle. During the intake stroke, the intake valve 42 opens and the exhaust valve 44 closes while the piston 34 moves from the top of the cylinder 22 to the bottom of the cylinder 22 to introduce air from the intake manifold to the combustion chamber. The piston 34 position at the top of the cylinder 22 is generally known as top dead center (TDC). The piston 34 position at the bottom of the cylinder is generally known as bottom dead center (BDC).

During the compression stroke, the intake and exhaust valves 42, 44 are closed. The piston 34 moves from the bottom towards the top of the cylinder 22 to compress the air within the combustion chamber 24.

Fuel is then introduced into the combustion chamber 24 and ignited. In the engine 20 shown, the fuel is injected into the chamber 24 and is then ignited using spark plug 48. In other examples, the fuel may be ignited using compression ignition.

During the expansion stroke, the ignited fuel air mixture in the combustion chamber 24 expands, thereby causing the piston 34 to move from the top of the cylinder 22 to the bottom of the cylinder 22. The movement of the piston 34 causes a corresponding movement in crankshaft 36 and provides for a mechanical torque output from the engine 20.

During the exhaust stroke, the intake valve 42 remains closed, and the exhaust valve 44 opens. The piston 34 moves from the bottom of the cylinder to the top of the cylinder 22 to remove the exhaust gases and combustion products from the combustion chamber 24 by reducing the volume of the chamber 24. The exhaust gases flow from the combustion cylinder 22 to the exhaust manifold 40 and to an aftertreatment system such as a catalytic converter.

The intake and exhaust valve 42, 44 positions and timing, as well as the fuel injection timing and ignition timing may be varied for the various engine strokes.

The engine 20 has a cylinder head 72 that is connected to a cylinder block 70 or a crankcase to form the cylinders 22 and combustion chambers 24. A head gasket 74 is interposed between the cylinder block 70 and the cylinder head 72 to seal the cylinders 22. Each cylinder 22 is arranged along a respective cylinder axis 76. For an engine with cylinders 22 arranged in-line, the cylinders 22 are arranged along the longitudinal axis 78 of the block 70.

The engine 20 has one or more fluid systems 80. In the example shown, the engine 20 has a fluid system with associated jackets in the block 70 and head 72, although any number of systems is contemplated. The engine 20 has a fluid system 80 that may be at least partially integrated with the cylinder block 70, and may also be at least partially integrated with the head 72. The fluid system 80 has a jacket 84 in the block 70 fluidly connected to a jacket 86 in the head, that may act as a cooling system, a lubrication system, and the like. In other examples, the system 80 may only be provided by a jacket 84 in the block 70, and a separate cooling system may be used to cool the head 72.

In the example shown, the fluid system 80 is a cooling jacket and is provided to remove heat from the engine 20. The amount of heat removed from the engine 20 may be controlled by a cooling system controller or the engine controller or via a temperature control device such as a thermostat. The fluid system 80 has one or more fluid jackets or circuits that may contain water, another coolant, or a lubricant as the working fluid in a liquid, vapor, or mixed phase state. In the present example, the fluid system 80 contains a coolant such as water, a water based coolant, a glycol based coolant, or the like. The fluid system 80 has one or more pumps 88, and a heat exchanger 90 such as a radiator. The pump 88 may be mechanically driven, e.g. by a connection to a rotating shaft of the engine, and/or may be electrically driven. The system 80 may also include valves, and the like (not shown) to control the flow or pressure of fluid, or direct fluid within the system 80 during engine operation, and may include components such as filters, degas lines, and sumps or reservoirs.

Various portions and passages in the fluid systems and jackets 80 may be integrally formed with the engine block and/or head as described below. Fluid passages in the fluid system 80 may be located within the cylinder block 70 and may be adjacent to and at least partially surrounding or completely surrounding each liner 32 in the block 70.

The cylinder liner 32 may be a different material than the block 70, or the same material as the block. The engine block 70 and cylinder head 72 may be cast from aluminum, an aluminum alloy, or another metal. The liner 32 may be formed from another material such as iron or a ferrous alloy. As such, one or more interfaces may be formed between the liner 32 and the surrounding block 70 of the engine based on the different materials in the two components. When the liner and the block are formed from different materials, a bimetallic interface is formed between these components, that adds further complexity to controlling the temperature of the block as well as controlling thermal expansion and stresses in the block. In other examples, the liner may be metal or metal alloy, and the block may be formed from a composite or other material.

Figure 2:
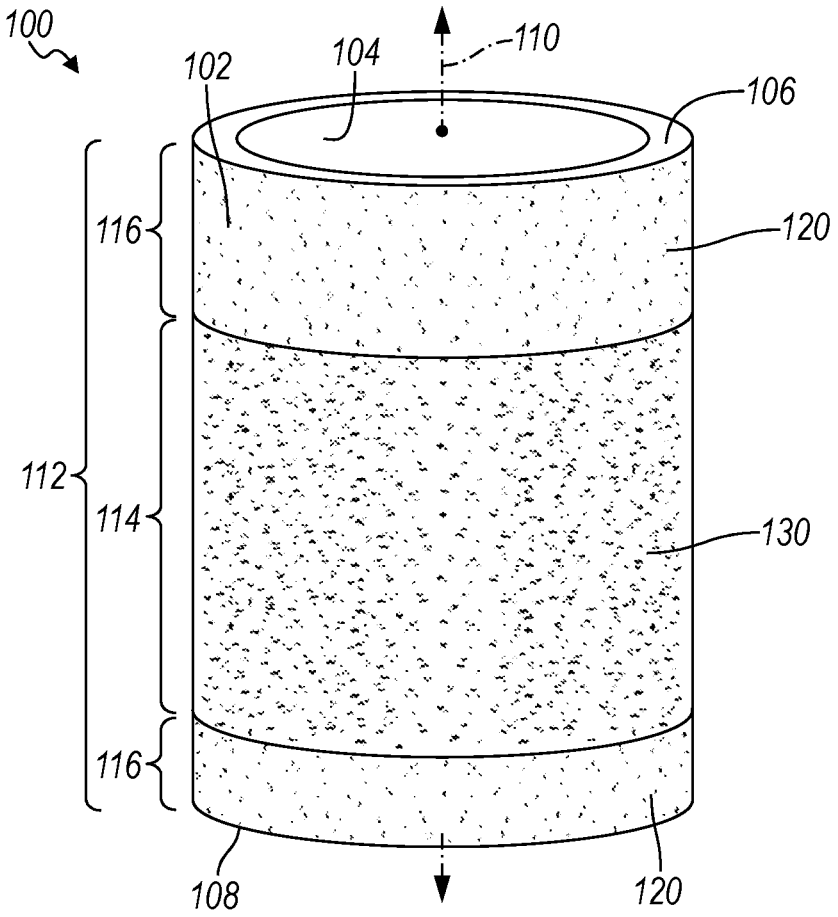
FIG. 2 illustrates a perspective view of a cylinder liner for use with the engine of FIG. 1.
Figure 3:
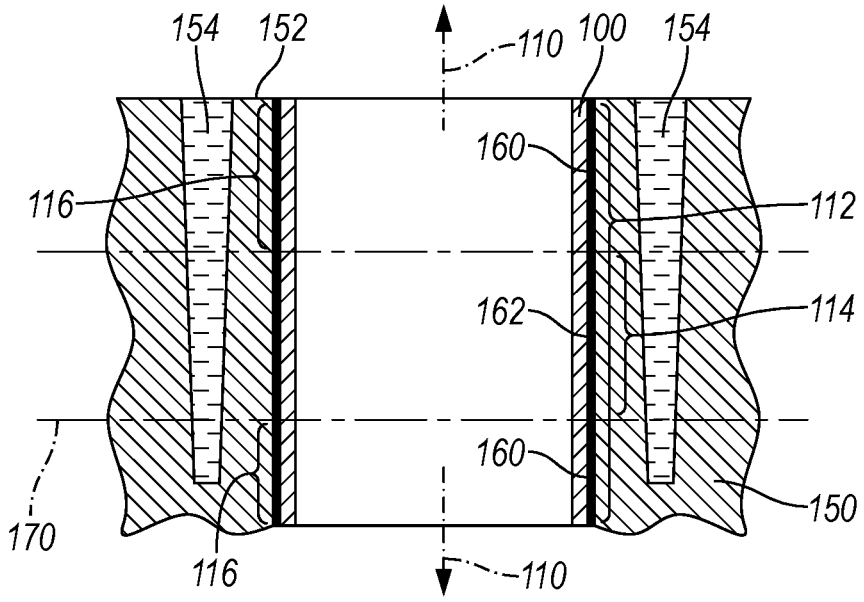
FIG. 3 illustrates a sectional view of the cylinder block for use with the engine of FIG. 1.
Figure 4:
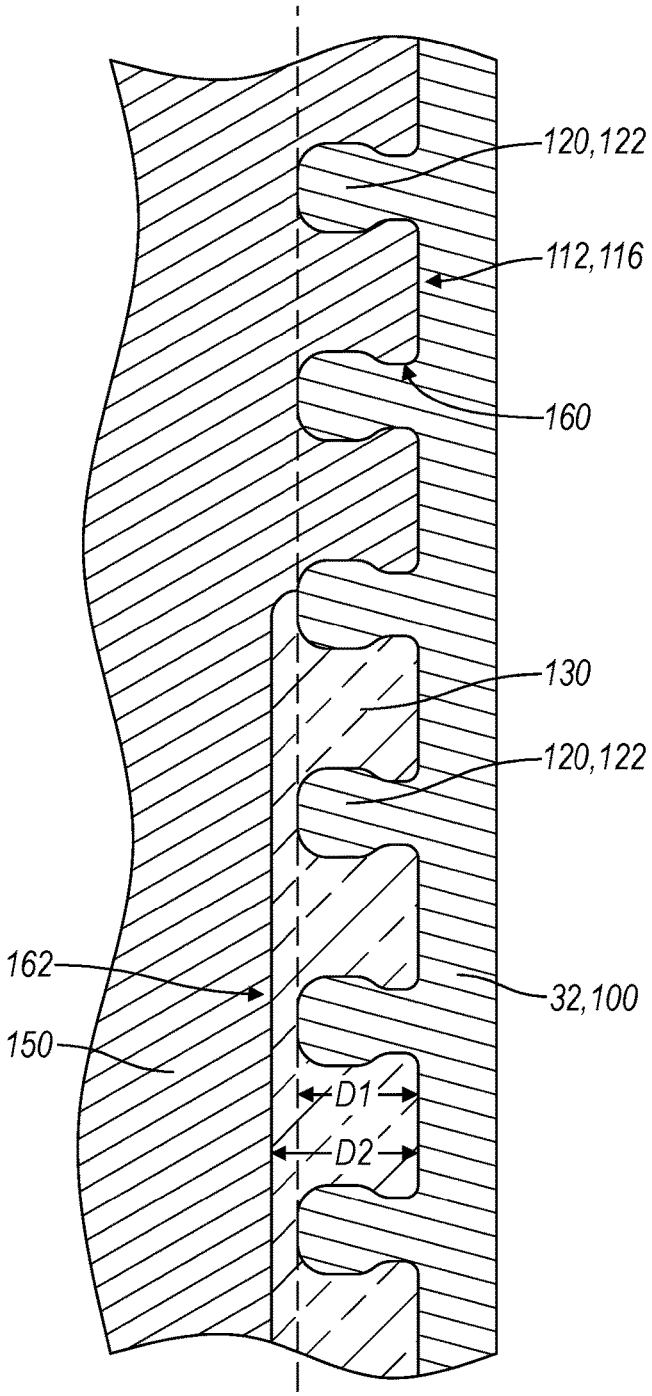
FIG. 4 illustrates a partial sectional view of the liner and the surrounding block of FIG. 3.

FIG. 2 illustrates a perspective view of a cylinder liner 100 for use with the engine 20 of FIG. 1, and may be used as liner 32. FIG. 3 illustrates the liner 100 as cast into an engine block 150. FIG. 4 illustrates a partial sectional view of the interfaces between the liner 100 and the adjacent block 150.

As shown in FIG. 2, the liner 100 is formed by a tubular member with an outer surface 102 or outer wall, and inner surface 104 or inner wall. The inner wall 104 forms the bore wall or cylinder wall 22 in the block 70. The inner and outer walls 104, 102 extend from a first end 106 of the liner to a second end 108 of the liner. The outer wall 102 extends about a circumference of the liner and along an axial length of the liner, e.g. along axis 110, which corresponds with axis 76 in FIG. 1.

The liner 100 has an axial section 112 or a circumferential section 112 of the outer surface 102. In one embodiment, the axial section 112 is directly adjacent to and extends between the first and second ends 106, 108 of the liner. In other examples, the section 112 may extend along only a portion of the liner, and may be adjacent to one of the ends or spaced apart from both ends.

The axial section 112 has a texture 120 or a series of projections 120 that cover the outer surface of the liner in this section. The texture 120 or projections are formed from the same base material as the liner 100, and may be integrally formed with the liner, for example, during a casting process.

The liner 100 also has another axial section 114 or another circumferential section 114 of the outer surface 102. The axial section 114 may be overlapping with the section 112 or be formed by only a portion of the section 112. The axial section 114 may be spaced apart from the first end 106 as shown. The axial section 114 may be spaced apart from the second end 108 as shown, or may be directly adjacent to the second end 108 in other examples. The axial section 114 is provided with a coating 130, as described further below, provided over the texture 120 on the outer surface in the section 114. Regions 116 therefore provide an uncovered texture 120 of the section 112.

The series of projections 120 has projections 122 that extend outwardly from the liner 100. The projections 122 may be fins, spines, or other protruding shapes with a circular or noncircular cross-sectional shape. In other examples, the projections 122 are formed by ribs that extend radially outwardly from the liner 100 and about at least a portion of the circumference of the liner. The cross-sectional area of the projection 122 may vary along a length of the projection. The projections 122 in the texture 120 may be regular or irregular in shape. The projections 122 may have an undercut or negative surface. In alternative examples, the texture 120 may include a porous structure along the outer surface of the liner, with the porous structure only extending a few millimeters into the liner.

In one example, each projection 122 has a generally circular cross-sectional shape that changes along a length of the projection, e.g. by decreasing and then increasing in area along an axial length of the projection such that it is constricted or undercut in an intermediate region of the projection. In other examples, the projection 122 may have a constant cross-sectional area along a length of the projection, or may decrease in area along a length of the projection. The projections 122 may be arranged in a random order or pattern on the surface 102, or may be organized into an array.

The series of projections 120 has an associated density of projections 122 over a projected area or base area of the liner, for example, a feature density of more than 10, 20, 30, or 40 projections per square centimeter. In one example, the feature density is on the order of 30 projections per square centimeter. The projections 122 may have an axial length or profile height D1 that is in the range of 0.05-3.0 millimeters, 0.05-2.0 millimeters, or on the order of 0.05-1.0 millimeter. The profile height of the projection may be related to the shape and type of projection, for example, a cast-in spine-type projection may range from 0.3-1.0 mm prior to any further machining, and a machined projection may have a profile height as small as 0.05 mm. Each projection 122 has an average diameter 126 that is less than an axial length of the projection.

The texture 120 or series of projections has an associated specific surface area. A specific surface area as defined herein is the actual surface area of the texture or projections per unit base area of the liner 100 that the projections extend over. For example, the specific surface area of the texture 120 is the actual surface area of the outer surface of the liner 100 including the projections 122 divided by a specified base area of the liner 100 that the first texture extends over, e.g. the actual area if the projections were not present. The specific surface area may be calculated using the actual surface area of the outer surface including the projections in a specified area of the outer surface of the liner, and a surface area of the outer liner over the same specified area of the outer surface of the liner assuming that no projections were present. For example, the first specific surface area is greater than one and is a dimensionless number, and may be in the range of 2-100, 10-50, or 20-40 in various examples.

The projections 122 may have a generally uniform size and shape, for example with dimensions of the projections being within ten percent of one another. The variability in the size of the projections may be based in part on the formation process for the projections.

In one example, the texture 120 is provided as a machined or otherwise formed texture. The texture 120 may include cones, continuous or interrupted segments of a male thread-like texture in bands of varying pitch, transverse splines or ribs, and other textures. In one example, the texture 120 is machined to have undercut surfaces. In alternative examples, more than one texture may be provided on the outer surface of the liner 100. The texture 120 may be provided with a uniform radial depth or profile height of the texture 120. In other examples, the texture 120 may have a profile height that varies with axial position along the liner, with sections with a constant profile depth and texture, and/or sections with a variable and continuously increasing or decreasing amount of projection removal, e.g. as a tapered section. As the profile depth of a texture 120 changes, the associated specific surface area and corresponding thermal conductivity also changes. The profile depth may be controlled to control heat transfer from the liner to the surrounding block, and improvements in uniformity of the bore wall temperature during engine operation may be realized.

The coating 130 may be provided as a layer outside of and covering the texture 120 on an outer surface 102 of the liner, and along an axial portion of the section 112, for example, along section 114. The coating 130 is provided circumferentially about the liner 100. In one example, as shown, the coating 130 is spaced apart from both end regions 106, 108 of the liner. In further examples, more than one coating may be applied, for example, as axially adjacent coatings with varying material properties, to further control the heat transfer from the liner to the surrounding block, and improvements in uniformity of the bore wall temperature during engine operation may be realized.

The coating 130 is provided as a thermally insulating layer about the liner 100 to reduce heat transfer from the liner to the surrounding block. In one example, the coating 130 comprises or includes a thermosetting polymer material, such as that formed from a thermoset resin or thermoset prepolymer. The coating 130 material properties includes both resistance to high temperatures as well as resistance to thermal stress and structural stress. Based on the operating temperatures of the engine and the casting process for forming the block, the coating 130 is required to withstand loads caused by thermal stresses to resist and prevent crack formation in the coating. Furthermore, the coating 130 is provided to have a predetermined and engineered thermal conductivity to control the heat transfer from the liner 100 to the block and control the bore wall temperature. The coating 130 also withstands and acts as an intermediate layer in relation to thermal expansion of the liner and block materials, which may differ from one another in bimetallic systems.

In one example, the coating 130 is provided as a composite material formed from a thermoset material and a particle fill. The thermoset material may be provided by a thermosetting polymer material, such as that provided by a thermosetting resin or prepolymer, and may include or comprise a phenolic resin or other materials such as an epoxy resin or the like. In one example, the thermoset material is a BAKELITE. The coating 130 does not contain thermoplastic materials that would melt or remelt under high temperatures experienced during a casting process or during engine operation. After curing and cross-linking the thermoset prepolymer, the thermoset material as used herein may be dimensionally stable up to 250 degrees Celsius or more, be chemically resistant, and have a compressive strength and flexural strength on the same order as or similar to that of metal. Additionally, the thermal expansion characteristics may be similar to that of a metal, which allows for use in a mixed material, high temperature environment. For example, the coefficient of linear thermal expansion (CTE) may be in the range of 0.10 to 0.25 $10^{-6}$/° C., which encompasses the CTEs for steel and aluminum.

The particle fill in the coating 130 may be provided by one or more of particles, fibers, and the like, and may include carbon, glass, basalt, graphene, and the like. In other examples, the coating may be provided by the thermoset material alone and without a particle fill. The particle fill may be provided to a specified fraction within the composite material and mixed with the resin material prior to application of the wet coating onto the liner. In one example, the particle fill is 10-40 percent by volume. The particle fill may be used to provide mechanical strength for the coating 130. The particle fill may additionally be used to control the thermal conductivity of the coating, for example, by reducing the thermal conductivity of the coating and providing increased insulative properties. The size, shape, density and/or distribution of the particle fill may be selected to control the coating 130 thermal conductivity, thermal expansion, mechanical properties, ease of manufacture, and cost. Additionally, a mixture of materials for the particle fill may be provided in the coating, for example, by providing two different materials and/or two different shapes, e.g. particle and fiber.

According to a non-limiting example of how the thermal conductivity may vary in a coating, a BAKELITE thermoset material has a thermal conductivity of 1.4 W/mK. By adding particle fill, the thermal conductivity may be varied. With a 60% graphite fill to the BAKELITE material, the thermal conductivity of a coating was increased by an order of magnitude, or to 12.3 W/mK. The particle fill may be further selected and varied to control the coating thermal conductivity. For example, graphite has a thermal conductivity of 130 W/mK which is much higher than a glass material. A phenolic-glass filled thermoset composite coating may have a thermal conductivity as low as 0.5 W/mK. The coating 130 with a particle fill may have a thermal conductivity that is one to two orders of magnitude lower than a metal or metal alloy, such as a cast aluminum alloy with a thermal conductivity of 96 W/mK.

The coating 130 may be provided over a smooth liner outer surface, however, there may be advantages for applying the coating 130 over the texture 120, such that the coating 130 is provided between the block 150 and the texture 120 of the liner in an axial region. When the coating 130 is applied to the outer surface of the liner 100 as a prepolymer resin mixed with the particle fill, it may flow between the projections of the texture 120, such that the coating 130 has better adhesion to the liner 100 due to the interface formed with the underlying texture 120. The coating 130 may be provided onto the liner 100 such that the thickness of the coating, D2, is greater than the profile depth, D1, of the underlying texture, and the coating therefore covers the projections 122 of the texture 120.

In one example, the coating 130 is provided with a constant or generally constant thickness D2 along the axial section 114. In other examples, the coating may be provided with varying thicknesses, for example, the coating 130 may have a thickness D2 that varies with axial position along the liner, with regions having with a constant thickness and/or regions with a variable and continuously increasing or decreasing thickness, e.g. as a tapered section. As the thickness D2 of the coating 130 varies, the associated heat transfer rate also changes to control the heat flux across the system, e.g. liner, coating, block and cooling jacket, changes. The thickness D2 may be controlled to control heat transfer from the liner 100 to the surrounding block 150 through the coating 130, and improvements in uniformity of the bore wall temperature during engine operation may be realized.

FIG. 3 illustrates a sectional schematic view of the liner 100 of FIG. 2 in an engine block 150. The cylinder block 150 is formed about the cylinder liner 100 with a first end 106 of the liner adjacent to or co-planar with a deck face 152 of the block 150. The block 150 defines a cooling jacket 154 extending circumferentially about at least a portion of the outer surface of the liner 100 and spaced apart therefrom. Cooling jacket 154 may form at least a portion of jacket 84 in fluid system 80. The block material surrounds and contacts the outer surface of each coated liner. Block 150 material may extend between adjacent liners 100 in an interbore region, and interbore cooling passage may be provided in the interbore region. The liner 100 is shown as having a first circumferential section 112 with a texture 120, and a second circumferential section 114 overlapping the first section 112 and having a coating 130.

The first circumferential section 112 of the outer surface 102 of the liner 100 has the uncoated texture 120 forming a first material interface 160 with the block 150, e.g. in regions 116. The regions 116 of the first circumferential section 112 are adjacent to the first end 106 and adjacent to the second end 108 of the liner, and in the present example the texture covers the outer surface of the liner. The block 150 material extends between adjacent projections 122 or the texture 120 surfaces in regions 116 to form an interlocking structure therewith and the first interface 160 as shown with the uncovered, textured regions of the liner 100. The first material interface 160 has a first thermal conductivity thereacross, as determined via experimental temperature measurements and heat transfer experiments.

The second circumferential section 114 of the outer surface 102 of the liner 100 has the coating 130 forming a second material interface 162 with the block 150. This circumferential section 114 is spaced apart from the first end 106 of the liner 100 and may be directly adjacent to or adjoin the regions 116 of the first section 112. The first circumferential section 112 is therefore positioned between the first end 106 and the second end 108. The block 150 material forms a second material interface 162 as shown with the outer surface of the coating 130. The second material interface 162 has a second thermal conductivity thereacross, as determined via experimental temperature measurements and heat transfer experiments. The second thermal conductivity is less than the first thermal conductivity.

In some examples, the second circumferential section 114 may be spaced apart from the second end 108 of the liner 100 as shown. In other examples, the second circumferential section 114 may extend to the second end 108 of the liner 100, such that there is no lower uncovered section 112. The second circumferential section 114 may overlap a piston ring height at bottom dead center.

The texture 120 and projections 122 on the outer surface 102 of the liner 100 interface with the block 150 material to increase the adhesion of the liner 100 within the surrounding block 150 material by providing for improved bond strength with the surrounding block material, especially when the liner 100 and block 150 are formed from different materials with different thermal expansions during engine operation. The texture 120 has a profile depth, D1, that provides an increased shear strength at an upper and lower region of the liner 100 to anchor the liner in the block. The texture 120 has surfaces that extend transversely to the liner outer surface, or have a transverse component thereto, to align with axial loading of the liner. The texture may additionally have undercut or negative pitch surfaces to align with radial loading of the liner.

The coating has a thickness, D2, that is equal to or greater than D1. In the example shown, the thickness D2 is greater than the profile depth D1 such that the texture is completely covered by the coating. According to one example, the coating thickness is greater than approximately 0.3 mm or 300 microns. In other examples, the coating thickness may vary based on the texture profile height, as described above.

In other examples, the coating 130 may be formed or post-processed prior to forming the block with shapes or textures on the outer surface of the coating 130 to interface with the block 150 material similarly to that of the texture 120 as described above.

The axial lengths, or lengths along axis 110, of each of the first and second sections 112, 114 and regions 116 are sized and positioned to control the bore wall temperature of the cylinder and liner 100 in the block 150 during engine 20 operation. The higher thermal conductivity in the regions 116 of the first circumferential section 112 provides for increased heat transfer adjacent to the hot, upper region of the cylinder 22. The reduced thermal conductivity in the second circumferential section 114 provides reduced heat transfer from the cylinder and liner 100 in this region, and allows the bore wall temperature to be warmer here than it would if the projections 122 and associated first thermal conductivity extended the length of the liner 100.

Figure 5:
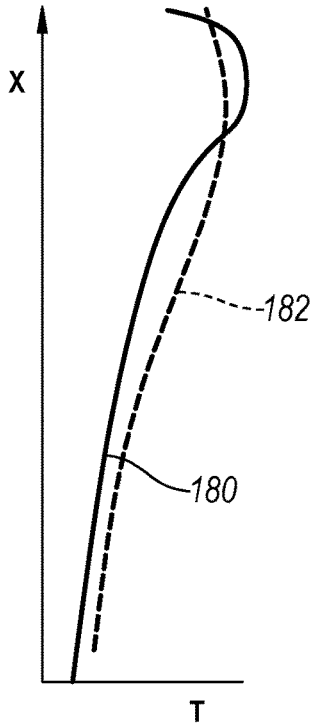
FIG. 5 illustrates an axial temperature profile for the block of FIG. 3 compared to a conventional liner in an engine block.

FIG. 5 illustrates a temperature plot illustrating bore wall temperature for a conventional cylinder liner with a smooth outer wall at line 180 compared to a cylinder liner 100 as shown in FIG. 3 during engine operation at line 182. As can be seen from the Figure, the disclosed cylinder liner 100 of FIG. 3 operates with a more uniform bore wall temperature than the conventional cylinder liner and a warmer bore wall temperature in an intermediate axial region of the liner 100. Various advantages are associated with a more uniform bore wall temperature which provides reduced bore distortion and maintains a more cylindrical shape of the liner 100 along the length of the liner. For example, reduced bore distortion may result in reduced piston ring friction and wear, reduced blow-by of combustion gases, reduced engine oil or lubricant consumption, increased temperature of lubricating fluids for improved and reduced viscosity, lower engine noise, and increased engine efficiency and improved fuel economy. The bore distortion may be related to the relative thicknesses of the liner and the surrounding block material. If the surrounding block material is relatively thick in comparison to the liner, it may be desirable to have a uniform axial temperature in the block material along the liner to reduce bore distortion, and the coating may be provided on the liner to improve oil viscosity between TDC and BDC by increasing the liner temperature at a mid-stroke axial location as the distortion by the liner itself is not the primary factor.

Figure 6:
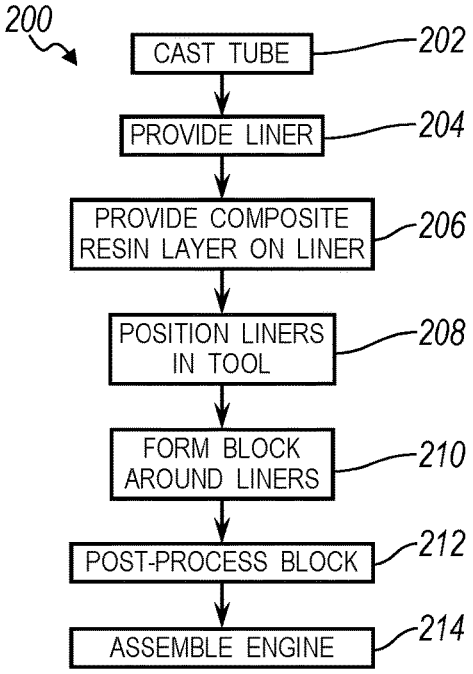
FIG. 6 illustrates a flow chart for a method of forming the engine of FIG. 1 according to an embodiment.

FIG. 6 illustrates a flow chart for a method 200 of forming an engine and of forming a liner for use in an engine, such as the liner 32 in engine 20 of FIG. 1, or liner 100 in block 150 in FIG. 2 above. The method may include greater or fewer steps than shown, the steps may be rearranged in another order, and various steps may be performed serially or simultaneously according to various examples of the disclosure.

At step 202, a tube is cast, and may be formed from iron or another ferrous alloy, steel, or the like. The tube is cast with an external surface and an internal surface, with each of the external and internal surfaces shaped to be round cylindrical, and arranged concentric with one another. The external surface of the tube is cast with a texture 120, e.g. a plurality of projections, extending circumferentially about the external surface and between opposite ends of the tube. The tube may be cast using a centrifugal casting technique or another casting process such that the texture 120 or plurality of projections are formed as a part of the casting process and are integrally formed with the liner at the time of casting. The tube may be formed with an axial length that corresponds to a number of liners, such that a liner 100 is formed by a portion or section of the tube. In other examples, the texture 120 may be machined or otherwise formed on the tube or liner.

At step 204 the tube is transversely machined or otherwise cut into two or more liners 100. The internal surface of the tube therefore corresponds with and provides an inner surface 104 of the liner. Likewise, the external surface of the tube corresponds with and provides the outer surface 102 of the liner.

The liner 100 is therefore provided with an outer surface 102 with the texture 120 provided thereon. The texture 120 is provided on the entire outer surface 102, or is provided to extend circumferentially about the liner 100 from a first end 106 to a second end 108 of the liner. The first texture 120 has an associated specific surface area and profile depth D1. For a texture with a series of projections 122, the projections 122 may be cast to be generally uniform in size and shape, e.g. dimensionally within a ten percent range. Optionally, the liner may then be machined or otherwise processed to vary the specific surface area and profile depth of the texture, e.g. using a shallow through-cut machine lathe process.

At step 206, a layer of a thermosetting prepolymer resin is provided on a section 114 of the outer surface 102 of the liner 100 to form the coating 130. Prior to application onto the liner 100, the resin may be mixed with particle fill to provide a composite coating. The section 114 or band of the outer surface 102 extends circumferentially about the outer surface 102 and along an axial section of the liner 100 that is less than an axial length of the liner 100.

The coating 130 is provided onto the surface of the liner 100 as a wet uncured prepolymer resin or composite mixture of a prepolymer resin and a particle fill. The coating 130 is dried and may be uncured, partially cured or fully cured prior to positioning the liner in the tool for forming the engine block. In curing the coating, the thermoset resin material cross-links to form the thermosetting polymer about the particle fill. The coating 130 may be dried, for example, using a post-baking process that provides sufficient temperatures to complete or partially complete the curing and cross-linking of the thermoset material, and evaporate any liquids or lubricants. The coating may additionally be cured or partially cured in various embodiments, or alternatively, may be left uncured until the block is formed at a later step as described below.

Figure 7:
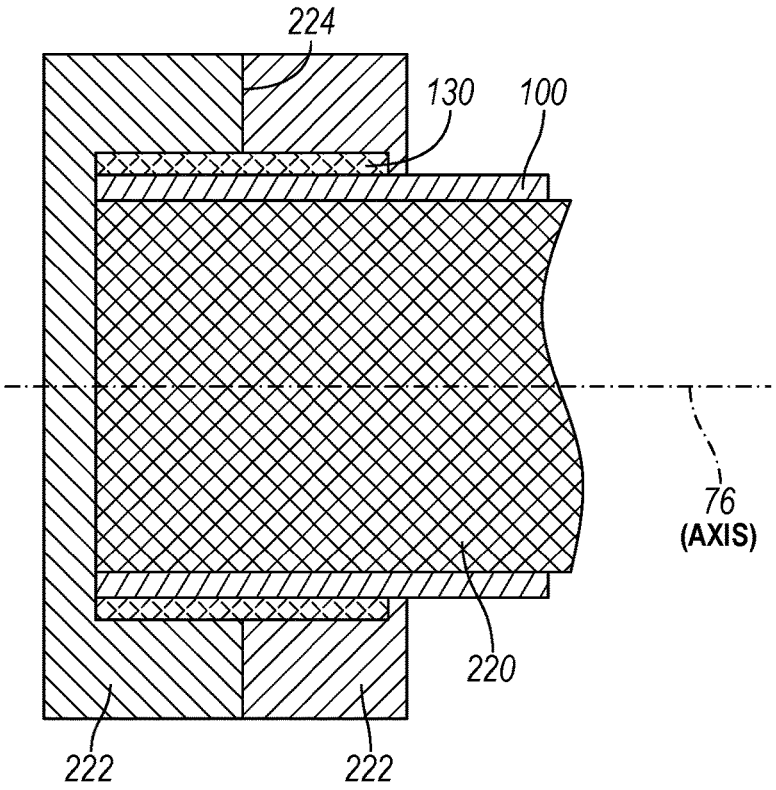
FIG. 7 illustrates a method of forming a coating on a liner according to an embodiment.

In one example, the coating 130 of the composite resin mixture is provided via a molding process, such as an injection molding process, as shown in FIG. 7. In FIG. 7, the uncoated liner 100 is positioned about a mandrel 220. One or more dies 222 that form the net shape or near net shape of the coating 130 are positioned about the mandrel and liner, and the composite resin mixture is injected into the tool.

For a coating 130 with a continuously varying thickness, e.g. as a taper, the tool for forming the coating on the liner may be provided such that the dies open and close along the longitudinal axis of the liner, as shown in FIG. 7. As such, the draft angle for the die(s) 222 providing the coating shape may correspond to the taper angle, and furthermore, the coating 130 is formed on the liner without part lines extending in the axial direction as the part lines 224 extend radially relative to the liner.

Figure 8:
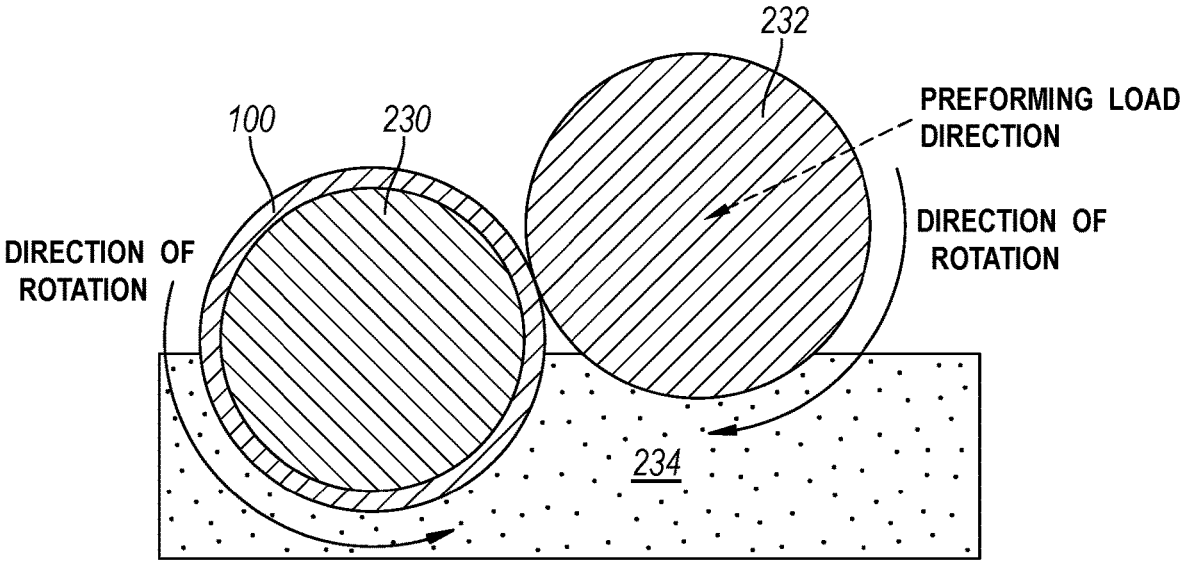
FIG. 8 illustrates a method of forming a coating on a liner according to another embodiment.

In another example, as shown in FIG. 8, the coating 130 of the composite resin mixture is provided onto the liner 100 via a compression molding process or pre-forming process. The uncoated liner 100 is positioned on a mandrel 230. The liner on the mandrel and another mandrel 232 or tool element are each at least partially submerged in a thermoset prepolymer powder bed 234 or thermoset prepolymer resin bath, and both rotate such that the prepolymer resin or powder is pressed onto the uncoated liner 100. A binder or other material may be used to aid in adhesion of the coating precursor onto the liner. Additionally, a particle fill may be provided in the bed 234 and mixed with the thermoset precursor material to form a composite coating on the liner.

In other examples, the uncured wet coating 130 may be provided onto the liner using a binder material, or using a spray process or the like. The coating processes described herein need to control the axial position of the coating 130 on the liner 100. Additionally, any flash material needs to be removed or not be present outside the desired regions 114 after coating or post-processing the coating and before step 208. Additionally, the coating 130 thickness needs to be controllable, and the integrity of the coating bond with the liner and the coating mechanical properties need to be sufficient to withstand chipping, spalling, or washout during a block forming process, such as die casting.

At step 208, the coated liners are positioned into a tool for forming the engine block. At step 210, the engine block is formed about the liners. In one example, the coating 130 is dried and in a green state or uncured state when the coated liner is positioned in the tool for forming the block. When the block is cast, for example, using a high pressure die casting process, the high temperatures of the injected molten metal act to cure the coating 130 such that the thermoset resin material cross-links to form a cured thermoset polymer, or finishes the curing process if the coating is partially cured when the liner is inserted into the tool. As the coating contains a thermosetting material, it is able to withstand the casting process. By curing the coating while forming the block, a manufacturing step of separately curing the coating on the liner may be omitted, and the engine block manufacturing process is more efficient.

The liner 100 is positioned within the tool, and various dies, slides or other components of the tool are moved to close the tool in preparation for a casting process. The dies and slides have cylinder block forming surfaces. The liners 100 are therefore used in an insert casting process to form the block 150. In one example, the tool is provided as a tool for a high pressure die casting process of metal, such as aluminum or an aluminum alloy. Additional inserts or die molding surfaces, including lost core inserts, may be provided to form other structures of the block such as the cooling jacket and associated passages.

After the tool is closed with the liner 100 positioned and constrained in the tool, material is injected or otherwise provided to the tool to generally form the engine block 150. In one example, the material is a metal such as aluminum, an aluminum alloy, or another metal that is injected into the tool as a molten metal in a high pressure die casting process. In a high pressure die casting process, the molten metal may be injected into the tool with a peak metal pressure of 6000 psi to 15000 pounds per square inch (psi) as the plunger comes to rest in the casting process. The molten metal may be injected at higher or lower pressures, and may be based on the metal or metal alloy in use, the shape of the mold cavity, and other considerations.

In one example, molten metal comprising aluminum is injected into the tool at a temperature of approximately 700 degrees Celsius, and the molten aluminum when reaching the coating in the tool has cooled slightly, for example to a temperature of approximately 650-680 degrees Celsius. The tool remains closed until the molten metal solidifies and the block may be ejected. The block is ejected typically at a temperature of 350-400 degrees Celsius, and the coating was at or above this temperature for at least twenty to thirty seconds to provide sufficient time for cross-linking and curing. In one example, the coating 130 includes a thermosetting resin such as a phenolic resin that cures and cross-links at a temperature of approximately 170 degrees Celsius or above.

During the block casting step 210, molten metal flows around and into contact with the outer surface 102 of the liner 100 and into the textures, e.g. between adjacent projections, threads, and the like, and around the coating 130. The molten metal cools and forms a casting skin such that the block 150 forms a first material interface 160 with the uncoated texture 120 of the outer surface of the liner and, a second material interface 162 with the coating. The first material interface 160 has a higher thermal conductivity than the second material interface 162. A combination of the specific surface area of the respective texture, the fluid dynamics, solidification, and contraction of the alloy surrounding the texture during casting, the thickness and material properties of the coating, and the thickness of the liner in the associated region may affect the thermal conductivity. As described above, the coating prepolymer material may cross-link and cure into a thermoset during the casting process based on the high temperatures of the molten metal.

In a further example, the textured region on the outer surface 102 of the liner 100 may be treated prior to being positioned in the tool to reduce oxidation. The liner 100 may have an outer surface 102 that is acid dipped, for example in fluoritic acid, and then rinsed to reduce oxidation and possible porosity issues in adjacent cast block material in a finished block 150 and improve contact between the liner 100 and the cast block 150 at the material interfaces. Alternatively, an inner surface 104 and/or outer surface 102 of the liner may be spray coated, for example, using a plasma spray coating, thermal spray coating, or another process.

The textured region and coated region on the outer surface 102 of the liner 100 provide different material interfaces with the surrounding cast engine block 150, which in turn provide different thermal conductivities and different heat transfer rates along the length of the liner to maintain a more uniform bore wall temperature during engine operation.

In a further variation, different liners 100 may be provided with different textures and or coatings, or have differing sizes or positioning of bands of the coating. The different liners may be used at different cylinder locations in an engine block, for example, to provide further thermal control and management via different thermal conductivities for liners 100 that are used as end cylinders or middle cylinders in an engine.

In another example, the engine block is formed by providing a composite material around the liner, for example, by an injection molding process or the like. The liner may comprise a metal or a metal alloy, and may include an iron based liner or an aluminum based liner with the coating 130 provided thereon as described above. The injection molding process may provide at least some of the heat and temperature needed to cross-link and cure the coating, or the coating may be cured prior to the injection molding process.

At step 212, the block 150 is removed from the tool, and undergoes various finishing steps. The process in step 210 may be a near net shape casting or molding process such that little post-processing work needs to be conducted. A surface of the block 150 may be machined to form the deck face 152 of the block adjacent to the first end 106 of the liner 100, for example, by milling. The unfinished block may also be cubed or otherwise machined to provide the final block for use in engine assembly. The inner surface of the liner 100 may be bored or otherwise finished.

At step 214, the finished block 150 may be assembled with a corresponding head, piston, crankshaft, etc. to form an engine such as engine 20.

Various examples of the present disclosure have associated non-limiting advantages. For example, during the operation of an internal combustion engine having a reciprocating piston design, combustion takes place in the combustion chamber. This combustion chamber may be located in a region where the head that is assembled to the block. The block defines cylinders that the pistons reciprocate within, and one end of each cylinder is associated with the combustion chamber. The combustion events within the chamber increase the temperature of the block surrounding the cylinders. Block heating may be greatest near the heat generating combustion event and lowest on the opposite end of the cylinder thus creating a temperature gradient along the axis of the cylinder. As a result of the increased temperature, the cylinder liner expands, and due to the temperature gradient, this expansion may be non-uniform along an axial length of the block. The cylinder liner and block according to the present disclosure provide a more uniform bore wall temperature that acts to maintain parallelism of the bore walls along the axial length of the cylinder and thereby reduce friction between the reciprocating piston and the cylinder wall.

An engine and cylinder block incorporates a cooling jacket surrounding or partially surrounding the cylinder bores and spaced apart from the bores and liners by the block material. The cooling jacket(s) contain a liquid fluid that is circulated around the cylinders to control the operating temperature of the engine by removing excess heat generated from the combustion events and transferring it to the atmosphere via a radiator or other heat exchanger. A difference in temperature between the cylinder wall or liner wall and a cooling jacket wall facing the cylinder drives the thermal flux, or movement of thermal energy, from the cylinder to the coolant in the jacket.

Conventional engine blocks may use a diverter or spacer in the cooling jacket, or a complex shape for the cooling jacket to try to thermally control and manage the cylinder wall temperature profile. Challenges exist for these techniques both in complexity of manufacturing, costs, and other tooling and assembly considerations.

The block according to the present disclosure provides for a cylinder wall with improved uniformity of the bore wall temperature. An intermediate region of the cylinder wall is at a higher temperature during engine operation than it normally would be for a conventional engine in that region, which reduces the temperature gradient along the axis of the cylinder providing a more uniform temperature, reduced distortion, and a more parallel bore for the reciprocating piston.

In the present disclosure, the liners are cast into the block, with the liners being formed from an iron or other ferrous material, while the block is cast from aluminum or an aluminum alloy. This results in the reduced weight and other advantages of an aluminum block combined with the wear properties of an iron cylinder.

The liner is provided with an exposed outside diameter cylinder texture on a portion and an insulating thermoset composite coating on another intermediate portion such that the interface of higher conductivity is nearest the combustion event and that of a lower conductivity is at the intermediate region or opposing end, and the cylinder bore wall temperature may be controlled as described.

Additionally, the liner may operate with a higher liner temperature overall, e.g. by increasing the temperature in the intermediate or mid-stroke region. This higher liner temperature, especially in the mid-stroke region overlapping with the coating, may provide for an increased temperature of lubricating fluids, e.g. engine oil, in this region and improved (reduced) viscosity where the piston is moving the fastest and the piston-to-bore wall interaction is the most dynamic. Additionally, a low piston speed, e.g. at the bottom of the bore, allows for more thermal loading at that location than an intermediate region above. In one example, the texture is provided at an upper section of the liner, and the texture is also provided at a lower section of the liner, while the intermediate section of the liner has the insulating composite coating. In this case, the texture provides an interlocking feature at the bottom of the liner and slightly increased thermal conductivity near BDC where the piston is slow and has more time to release heat to the surrounding block. In other examples, the coating may overlap with BDC based on the specific engine configuration and operating state. The coating in an intermediate or central region provides an insulating layer to reduce heat transfer and regionally raise the liner temperature for reduced bore distortion and reduced lubricant viscosity.

The coating material may be applied to an outer surface of the liner in an over-molding operation where complete cross-linking of the material is achieved or, in another embodiment, shaped to the desired geometry onto the liner prior to the casting process and allowing for the process temperatures to complete the cross-linking of the thermoset prepolymer during the casting process. The nature of a thermoset material is such that it does not revert to viscous state or soften or plasticize with the application of thermal energy as a thermoplastic would. Therefore, the thermoset boundary layer remains stable at high temperatures such as those during a high pressure die casting process, and the coating remains intact. Mechanical properties of a thermoset material may degrade to some extent at elevated temperatures; however, the thermal boundary layer provided by the coating remains intact and effectively insulates the bore in the desired regions.

Furthermore, the thermoset resin material may be applied within the valleys of a texture, e.g. between the projections, thereby also reducing the conductive specific surface area in the region of its application while a highly conductive specific surface area is maintained in the uncovered texture regions with the aluminum-iron boundary and interface.

While exemplary embodiments are described above, it is not intended that these embodiments describe all possible forms of the disclosure. Rather, the words used in the specification are words of description rather than limitation, and it is understood that various changes may be made without departing from the spirit and scope of the disclosure. Additionally, the features of various implementing embodiments may be combined to form further embodiments of the disclosure.

What is claimed is:

1. An engine comprising:

a cylinder liner having an outer surface and an inner surface extending from a first end to a second end of the liner; and a cylinder block formed about the cylinder liner with a first end of the liner adjacent to a deck face of the block, the block defining a cooling jacket extending circumferentially about at least a portion of the outer surface of the liner and spaced apart therefrom;

wherein a first circumferential section of the outer surface of the liner has a texture that is uncoated to directly form a first material interface with the block, the first material interface having a first thermal conductivity thereacross;

wherein a second circumferential section of the outer surface of the liner has the texture with a coating provided thereon and forming a second material interface with the block, the coating comprising a thermoset resin, the second material interface having a second thermal conductivity thereacross, the second thermal conductivity being less than the first thermal conductivity;

wherein the first circumferential section is positioned between the first end and the second circumferential section; and wherein the second circumferential section is directly adjacent to the first circumferential section and is spaced apart from the second end of the liner, the second circumferential section overlapping a piston ring height at bottom dead center.

2. The engine of claim 1 wherein the coating further comprises a phenolic resin and a particle fill.

3. The engine of claim 1 wherein the coating has a thickness (D2), wherein the texture has a profile depth (D1), and wherein D2 is greater than D1.

4. The engine of claim 1 wherein the texture is defined by the liner such that a specific surface area of the texture varies with the axial position of the liner.

5. An engine cylinder liner comprising:

a tubular member having first and second ends with an outer surface extending therebetween and defining an axial section with a texture, the axial section with the texture extending from the first end to the second end of the tubular member, the texture and the liner having a first thermal conductivity, wherein the first end of the tubular member is configured to be positioned adjacent to a deck face of an engine cylinder block; and a coating provided over the texture and circumferentially about only a first portion of the axial section such that a second portion of the axial section is uncoated, the coating comprising a thermoset resin material having a second thermal conductivity that is less than the first thermal conductivity, wherein the first portion of the axial section and the coating are spaced apart from the first and second ends of the tubular member; and wherein the second portion of the axial section with the texture that is uncoated is positioned between the first end of the tubular member and the first portion of the axial section;

wherein the first portion of the axial section is directly adjacent to the second portion of the axial section and is positioned to overlap a piston ring height at bottom dead center;

wherein the texture that is uncoated on the second portion of the axial section is configured to directly form a first material interface with the block having the first thermal conductivity thereacross; and wherein the texture with the coating of the first portion of the axial section is configured to form a second material interface with the block having the second thermal conductivity thereacross.

6. The engine cylinder liner of claim 5 wherein the coating further comprises a particle fill.

7. The engine cylinder liner of claim 5 wherein the liner comprises one of a metal and a metal alloy;

wherein the coating is provided by a composite material comprising the thermoset resin material and a particle fill; and wherein the thermoset resin material comprises a phenolic resin.

8. The engine cylinder liner of claim 7 wherein the particle fill comprises at least one a basalt fiber and a graphene particle.

9. The engine cylinder liner of claim 5 wherein the texture is integrally formed with the tubular member.

10. The engine cylinder liner of claim 5 wherein the texture comprises a series of projections.

11. The engine cylinder liner of claim 5 wherein the texture is defined by the liner such that a specific surface area of the texture varies with the axial position of the liner.

12. The engine cylinder liner of claim 5 wherein the coating is provided such that a thickness of the coating varies with the axial position of the liner.

13. The engine cylinder liner of claim 5 wherein the second portion of the axial section of the tubular member with the texture that is uncoated provides a first outer diameter for the liner;

wherein the first portion of the axial section of the tubular member with the coating provides a second outer diameter for the liner; and wherein the second outer diameter is greater than the first outer diameter.

14. The engine cylinder liner of claim 5 wherein the coating has a thickness (D2), wherein the texture has a profile depth (D1), and wherein D2 is greater than D1.

* * * * *